US007171917B2

(12) United States Patent
Poiraud

(10) Patent No.: US 7,171,917 B2
(45) Date of Patent: Feb. 6, 2007

(54) ASYMMETRICAL UNBALLASTED ANCHOR

(76) Inventor: Alain Poiraud, Hylas-B.P. 212 - Eragny, Cergy Cedex (FR) 95614

( * ) Notice: Subject to any disclaimer, the term of this patent is extended or adjusted under 35 U.S.C. 154(b) by 0 days.

(21) Appl. No.: 10/720,278

(22) Filed: Nov. 25, 2003

(65) Prior Publication Data

US 2004/0206291 A1 Oct. 21, 2004

(30) Foreign Application Priority Data

Mar. 27, 2003 (EP) ..... 03290782

(51) Int. Cl.
*B63B 21/30* (2006.01)
*B63B 21/32* (2006.01)

(52) U.S. Cl. ..... 114/301

(58) Field of Classification Search ..... 114/293, 114/294, 297–311; D12/215
See application file for complete search history.

(56) References Cited

U.S. PATENT DOCUMENTS 3,749,044 A * 7/1973 Klaren ..... 114/301
4,173,938 A * 11/1979 Colin ..... 114/301
4,523,539 A * 6/1985 Granger ..... 114/299
5,138,967 A * 8/1992 McCarron et al. ..... 114/301
5,188,055 A * 2/1993 Kershner ..... 114/299
5,511,506 A * 4/1996 Bruce ..... 114/301
D375,717 S * 11/1996 Dick ..... D12/215
5,806,456 A * 9/1998 Peabody ..... 114/301
5,855,181 A * 1/1999 Oxford ..... 114/301
5,934,219 A * 8/1999 Poiraud ..... 114/301
6,332,423 B1 * 12/2001 Petersen ..... 114/301
6,390,011 B1 * 5/2002 Goodman ..... 114/301

FOREIGN PATENT DOCUMENTS

EP 1279590 A1 * 1/2003
FR 2769576 A3 * 4/1999
FR 2820108 A1 * 8/2002
JP 04039190 A * 2/1992

* cited by examiner

*Primary Examiner*—Ajay Vasudeva
(74) *Attorney, Agent, or Firm*—Rothwell, Figg, Ernst & Manbeck

(57) ABSTRACT

An asymmetric boat anchor has an unballasted fluke (2), with a tip (6) and a back (8) with a curved edge (10); a shank (4) is mounted on the fluke. The edge (26) of the shank away from the tip (6) of the fluke is curved and the free end of the shank (18) is offset from a plane (30) tangent to the back edge (10) of the fluke and to the edge (26) of the shank. Thus, if the anchor is in a reverse position, contacting the sea ground through the edge of the shank and the back edge of the fluke, it will roll on the edge of the shank and turns to the anchoring position.

13 Claims, 1 Drawing Sheet

ASYMMETRICAL UNBALLASTED ANCHOR

BACKGROUND OF THE INVENTION

1. Field of the Invention

The invention relates to the field of boat anchors and more specifically to asymmetrical anchors.

Danforth, Fortress, Plastimo, FOB and others sell articulated anchors. The fluke is formed of a flat metal plate. The shank is linear and is articulated at one end to the fluke, between two tips of the fluke. This type of anchor is not very efficient, since the fluke tends to remain parallel to the sea ground. This anchor is symmetrical.

2. Description of the Prior Art

Rolf KACZIREK located in GETTORF, Germany, sells under the trademark Bügel anchor, an anchor formed of a flat metal plate, with a triangular shape. One angled end of the triangle forms the tip of the anchor. There is provided along the side of the plate opposed to the tip an arc (bügel). A linear shank is welded to the plate. The arc ensures that the anchor rotates when it impacts on the sea ground, so that the anchor lies on its side, with the tip, the rear of the plate and the end of the shank touching the sea ground. The drawback of this type of anchor is that the arc at the rear part of the fluke adds weight, at a location that will not contribute to the burying of the anchor into the sea ground. In addition, since the fluke is formed of a flat metal plate, it needs to be thick to keep its shape when used. This increases the costs of the anchor and the unnecessary weight.

EP-B-0 840 691 discloses a marine anchor, having a fluke folded along a line, so as to form a V-shaped cross section. A shank is welded to the fluke. A ballast is provided at the tip of the anchor fluke; the back of the fluke has a quasi-elliptical shape with a concave surface. Thanks to the ballast at the tip of the fluke, the centre of gravity of the anchor is located near to the tip. Thus, when the anchor falls on the sea ground, it automatically positions itself in a lateral position, where it lies on the tip of the fluke, on one side of the elliptically-shaped back of the fluke and on the extremity of the shank. In this position, the anchor easily penetrates into the sea ground, due to the V-shaped tip of the fluke and the heavily ballasted tip. The operation of the anchor disclosed in this document is fully satisfactory and improves over other prior art anchors. Still, there is a need for an anchor that would be easier and cheaper to manufacture and more efficient.

FR-A-2 820 108 discusses an anchor with a similar shape, where the shank is movably mounted on the fluke.

The anchors discussed in these documents are known in the art as asymmetrical anchors. Although there exists a plane of symmetry, the shank is not mounted symmetrically on the fluke; it extends on one side of the fluke.

Accordingly, there is still a need for an anchor, which would be easy to manufacture, solid and more efficient.

SUMMARY OF THE INVENTION

In one embodiment, the invention provides an asymmetric boat anchor, comprising an unballasted fluke having a tip and a back with a curved edge and a shank mounted on the fluke, with an opening at an end opposite the fluke. The edge of the shank away from the tip of the fluke is curved and the opening is offset from a plane tangent to the back edge of the fluke and to the edge of the shank.

The anchor may also present one or more of the following features:

- the ratio of the surface of the fluke to the weight of the anchor is higher than 80 $cm^2$/kg, and preferably higher than 100 $cm^2$/kg;
- the centre of mass of the fluke is located nearer to the back edge of the fluke than to the tip of the fluke;
- the shank is mounted on the half portion of the fluke near to the tip;
- the proportion of the weight of the anchor on the tip is higher than 20%;
- the fluke is formed of a metal plate of constant thickness;
- the angle between a bottom line of the fluke and a line from the geometric centre of the fluke to the opening is from 30 to 38°, and preferably about 34°;
- the shank has an second opening and the angle between a bottom line of the fluke and a line from the geometric centre of the fluke to the second opening is from 40 to 50°, and preferably about 45°;
- the fluke is provided with a sand-guide at a upper side of the back;
- the shank is provided with a protruding portion at its lower edge.

BRIEF DESCRIPTION OF THE DRAWINGS

An anchor embodying the invention will now be described, by the way of non-limiting example, and in reference to the accompanying drawings, where.

DETAILED DESCRIPTION OF THE PREFERRED EMBODIMENTS

Figure 1:
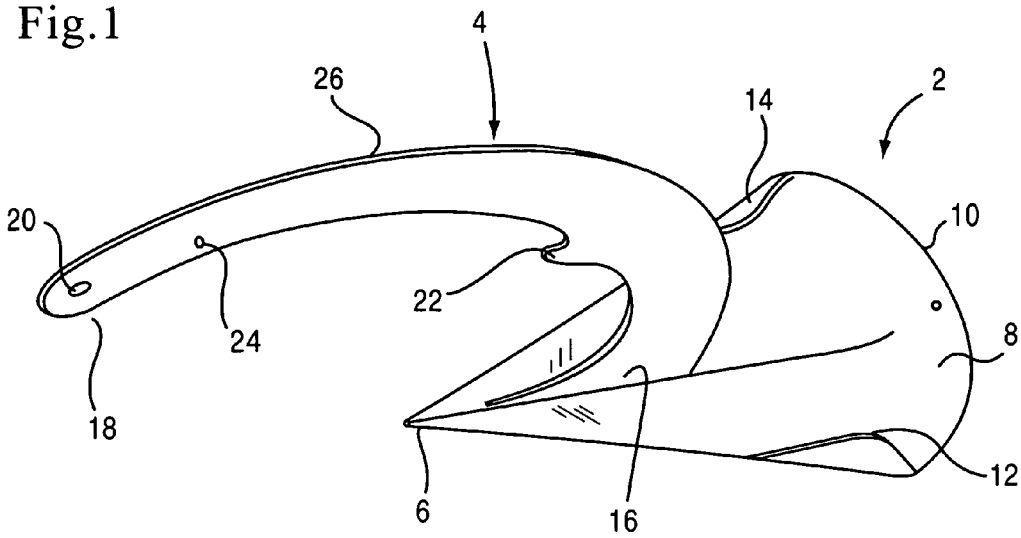
FIG. 1 is a schematic view of a anchor according to one embodiment of the invention.

The invention is based on the fact that the efficiency of an anchor does not increase with its weight, but with the efficient surface of its fluke. Thus, it overcomes the prejudice of the prior art, according to which an anchor should be as heavy as possible. Contrary to this prejudice, the invention proposes to increase the surface of the anchor, compared to prior art anchors having similar weights. This allows the anchors, once buried into the sea ground, to efficiently resist traction on the shank. In addition, the invention eliminates or limits the need for ballasting the anchor; this simplifies the manufacture of the anchor and makes it less costly.

The invention thus provides an unballasted asymmetric anchor. The anchor is unballasted, in that there is no need to provide additional ballasting on the fluke—as in EP-B-0 840 691 or in FR-A-2 820 108. This does not exclude the use of reinforcing elements, e.g. on the tip of the anchor; however, these elements have little effect or substantially no effect on the efficiency of the anchor. This can be evidenced by locating the centre of mass of the fluke. In a ballasted fluke, as the prior art discloses, the centre of mass of the fluke is near to the tip of the fluke—due to the ballast. On the contrary, in an unballasted fluke, the centre of mass of the fluke is nearer to the back of the fluke.

The simplest example of unballasted anchor is disclosed in reference to the drawings; the fluke is formed of a metal sheet having a constant thickness. The metal sheet may be formed, as in the example of the figure; otherwise, the fluke may be formed of two stamped metal parts that are assembled, e.g. by welding.

The fact that the anchor is unballasted may also be expressed by the ratio of the surface of the fluke to the weight of the anchor. The surface of the fluke is measured as the projection of the fluke in a plane containing the bottom line of the fluke. The ratio for the prior art anchor disclosed in EP-B-0 840 691 is around 45 to 65 $cm^2$/kg. For the anchor of the invention, the ratio is higher than 80 $cm^2$/kg, and preferably higher than 100 $cm^2$/kg. Even more preferably, the ratio is higher than 115 $cm^2$/kg.

The anchor of the invention has an anchoring position, as disclosed in EP-B-0 840 691, where it contacts the sea ground by the tip of the fluke, one side of the back of the fluke and the free end of the shank. This is a position of stable equilibrium. Any traction on the free end of the anchor shank will result in the tip penetrating the sea ground.

An unballasted anchor may have a position of unstable equilibrium, when it lies on the sea ground, in a reverse position. In this unstable position, the anchor contacts the sea ground through the back of the fluke and the top edge of shank. For ensuring that the anchor turns to the anchoring position, the invention provides that, in the unstable equilibrium position, the free end of the shank is offset from the sea ground. In other words, the free end of the shank is offset from a plane tangent to the back of the fluke and to the upper edge of the shank. This ensure that when the traction of the anchored boat pulls on the free end of the shank, the anchor will roll on the upper edge of the shank, to the anchoring position. This rolling of the anchor is facilitated when the upper edge of the shank, between the free end and the point of tangency of said plane, is curved.

Thanks to these features, the anchor will always return to the anchoring position, even though it is unballasted. Once in the anchoring position, it will penetrate the sea ground, as explained below in reference to the drawings.

FIG. 1 is a schematic view of an anchor according to one embodiment of the invention. In this embodiment, the anchor is formed of stamped metal plates, assembled by welding. FIG. 1 shows the fluke 2 of the anchor and the shank 4. The fluke is substantially triangular, with a tip 6 and a curved back 8. In cross section, in a plane perpendicular to the plane of the shank, the tip of the anchor is V-shaped; this facilitates penetration of the anchor in the sea-ground; the angle formed at the tip of the anchor by the two lateral portions of the fluke may be in the range of 130 to 160°, preferably around 145°. The fact that the anchor is unballasted also facilitates penetration, since the tip of the anchor may be as thin as the rest of the fluke.

The back of the fluke is curved, like a spoon. This helps in improving the holding of the anchor, when the anchor is buried in the sea bottoms. In addition, the edge 10 of the back of the fluke is also curved. The curved shape of the back edge 10 of the fluke facilitates rotation of the anchor from its unstable equilibrium position to the stable equilibrium position of anchoring.

On one or both sides of its back edge, the fluke may be provided with ears 12, 14. These ears or lateral sand-guides extend at an angle of about 70° to the surface of the fluke, or with a small angle to the sea-ground (like the working angle of a spreader) when the anchor is in the anchoring position. They restrain the burying of the back of the fluke into the sea-ground, thus helping penetration of the tip of the anchor when the anchor is pulled by the boat.

The shank 4 of the anchor is also manufactured, in the example of FIG. 1, out of a metal plate. The shank is mounted by one end 16 to the fluke, e.g. by welding on the fluke. One may use other mounting methods, such as bolts or nuts. One may also use a shank having a prismatic cross-section in an correspondingly shaped opening of the fluke, as already known in the art, as for example on the Luke anchor or as described in FR-A-2 820 108. The other end of the shank—or free end in the rest of this specification—is provided with an opening 20 for fixing the end of a rope or chain used for anchoring the boat. The lower edge of the shank—the edge facing the tip of the anchor—is provided with a protruding part 22. A second opening 24 can be located either on the upper or on the lower edge, the use of which is discussed below. The upper edge 26 of the shank—the edge away from the tip of the anchor, or facing the back of the fluke—is also curved, for the reasons discussed in reference to FIG. 2.

Figure 2:
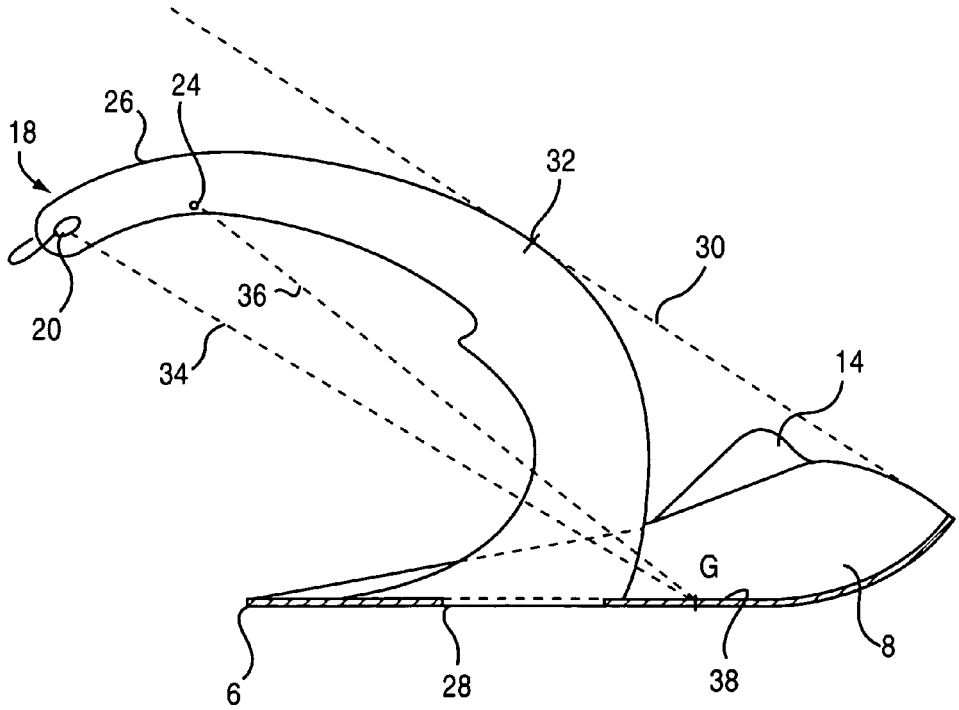
FIG. 2 is a side view of the anchor of FIG. 1.

As represented in FIG. 1, the shank extends beyond the fluke, over the tip of the fluke. This helps in increasing the proportion of the weight of the anchor on the tip 6 of the anchor. In addition, as best seen in FIG. 2, the shank is mounted on the front part of the fluke, that is nearer to the tip 6 than to the back 8 of the fluke. The position of the shank may be measured by considering the front and back contact points, or by considering the intersection of the fluke with the medium line between the lower and upper edges. As apparent from FIG. 2, in both cases, the shank in embodiment of the figures is nearer to the tip than to the back of the fluke. Again, this feature helps in increasing the proportion of the weight of the anchor on the tip. This proportion may be measured by positioning the anchor, in the anchoring position, on three scales located at the three points of contact. It is preferred that the proportion of weight on the tip be higher than 20%; in the example, the proportion is around 23%. This is considerably higher than the proportion of weight in the unballasted anchor of the prior art discussed above, which is around 16%.

The fluke may be manufactured as discussed in EP-B-0 840 691, except for the fact that there is no need for a ballast. The shank may be stamped or cut out of a metal plate.

FIG. 2 is a view of the anchor of FIG. 1, in cross section along the symmetry plane of the anchor. It shows the mounting of the shank in an opening 28 of the fluke, the shank being subsequently welded from below or from above the fluke. FIG. 2 further shows the curved back 8 of the fluke, the bottom line 38 of the fluke being horizontal in FIG. 2. FIG. 2 shows, in dotted lines, the plane 30 tangent to the curved back edge 10 of the fluke and tangent to the upper edge 26 of the shank 4. As shown on FIG. 2, the plane contacts the upper edge 36 of the shank at a point 32. When the anchor is in the unstable equilibrium position, the sea ground corresponds to plane 30. The anchor contacts the sea ground at point 32 and at the point of the back edge of the fluke contained in the symmetry plane of the anchor. As discussed above, the free end 18 of the shank is offset from plane 30. This ensures that when the anchor is in the unstable equilibrium position on the sea ground, the free end is above the sea ground. Thus, if the anchor is in the unstable equilibrium position, the pulling force of the boat chain or rope will tend to pull the free end of the shank down to the sea ground. This has the consequence that the anchor will roll on the upper edge of the shank, between the point 32 and the free end of the shank. The anchor will then automatically rotate from the unstable equilibrium position to the anchoring position.

As explained above, the rolling movement is facilitated by the fact that the upper edge of the shank is curved or convex, at least between the contact point 32 and the free end 18 of the shank. FIG. 2 shows that, under the assumption that the sea ground is flat, the shape of the upper edge of the shank between contact point 32 and the fluke has no relevance. Practically speaking, it is preferable that the upper edge of the shank be also convex between point 32 and the fluke. Thus, in case the sea ground is not perfectly flat, the anchor will also roll on the upper edge of the shank, even in the part of the upper edge located between point 32 and the fluke.

FIG. 2 further shows the geometric center G of the fluke. In the exemplified embodiment, this geometric center is also the center of mass of the fluke, since the fluke is formed in a metal plate having a constant thickness. As discussed above, the center of mass is nearer to back edge 10 of the fluke than to the tip 6 of the fluke. In projection on the bottom line 38, the distance from the center of mass to the tip of the anchor is around 63% of the total length of the fluke. A range above 50% is representative of unballasted flukes, as discussed above.

FIG. 2 shows that the angle between the bottom line 38 of the fluke—horizontal in the example—and a line 34 joining the geometric center G and the opening 20 at the free end of the fluke is around 34°. The preferred range for this angle is from 30 to 38°. This range is the most adapted for helping penetration of the tip of the anchor in sandy grounds. However, for muddy or sludgy grounds, the preferred angle is around 45°, in the range of 40° to 50°. For this reason, the shank 2 is further provided with a second opening 24. The angle between the bottom line 38 of the fluke and a line 36 joining the geometric center G and the second opening 24 is 45° in the example of FIG. 2. The second opening makes it possible to attach the chain of the boat directly to the second opening, for improving performance of the anchor in muddy grounds. Another solution consists in providing a bow shackle in the second opening. Rather than changing the position of the end of the chain, one may simply pass the chain through the bow shackle of second opening 24. This has the effect of changing the attachment point, for all purposes, but does not make it necessary to disassemble the chain.

As shown in FIG. 2, the second opening is also offset from plane 30. Thus, even if the second opening is used for attaching or passing the chain of the boat, the anchor of FIG. 2 will not remain in the unstable equilibrium position.

FIG. 2 again shows the protruding part 22 on the lower edge of the shank. This is useful for blocking the anchor on the bow roller, when the anchor is pulled up. This avoids any damage that the tip of the anchor may cause on the bow of the boat. It remains possible to raise the anchor, so that the protruding part 22 passes the bow roller. The anchor may then be fixed or attached to the bow. One also understands that a concave continuous lower edge improves the ability to raise the anchor and to have it roll over the bow roller.

The following table lists, for several possible values of the weight of the anchor, the thickness of the fluke, the thickness of the shank, the surface of the fluke, the dimensions of the fluke, as well as the offset between the axis of the fixation opening 20 and the horizontal plane 30 when the anchor is in reverse position.

| | | | | |
|---|---|---|---|---|
| Weight (kg) | 4 | 8 | 12 | 16 |
| Fluke thickness (mm) | 5 | 5 | 6 | 6 |
| Shank thickness (mm) | 8 | 8 | 10 | 10 |
| Fluke surface ($cm^2$) | 536 | 1070 | 1298 | 1738 |
| Fluke dimensions (mm × mm) | 392 × 267 | 553.7 × 377.5 | 610 × 416 | 706 × 481 |
| Offset (mm) | 140 | 177 | 200 | 233 |

The table shows that the ratio of the fluke surface to the weight of the anchor is above 100 $cm^2$/kg, for each of the examples. This is higher than the preferred lower value of 80 $cm^2$/kg. For the first two examples, the ratio is around 134 $cm^2$/kg, which is higher than the more preferred value of 115 $cm^2$/kg. As a comparison, for the prior art solution of EP-B-0 840 691, the ratio is around 55 $cm^2$/kg. The table further shows that the offset between plane 30 and the opening 20 is higher than 10 cm, in all embodiments. It is higher than 15 cm for anchor with a weight of more than 4 kg.

The anchor of the invention has a surface substantially higher than prior art anchors having the same weight. Compared to the prior art solution of EP-B-0 840 691, the surface of the anchor fluke is twice as important. The improvement in efficiency—sustainable boat pull—is in the same ratio. Again, the anchor of the invention provides improved results thanks to the overcoming of the prior prejudice on ballasting.

The invention is not limited to the preferred embodiments discussed in reference to the drawings. Notably, one may change the shape of the rear part 8 of the fluke. It is spoon-shaped in the drawings, but could be faceted or shaped otherwise. The upper or lower edges of the shank could be partly discontinuous.

The invention claimed is:

1. An asymmetric boat anchor, comprising an unballasted fluke (2) having a tip (6) and a back (8) with a curved edge (10);

a shank (4) mounted on the fluke, with an opening (20) at an end (18) opposite the fluke;

wherein an edge (26) of the shank away from the tip (6) of the fluke is curved and wherein the opening (20) is offset from a plane (30) tangent to the back edge (10) of the fluke and to the edge (26) of the shank;

wherein the shank is mounted on the half portion of the fluke near to the tip (6).

2. The anchor of claim 1, wherein the ratio of the surface of the fluke (2) to the weight of the anchor is higher than 80 $cm^2$/kg.

3. The anchor of claim 1, wherein the center of mass of the anchor is located nearer to tip (6) of the fluke than to the back edge (10) of the fluke.

4. The anchor of claim 1, wherein the proportion of the weight of the anchor on the tip is higher than 20%.

5. The anchor of claim 1, wherein the fluke is formed of a metal plate of constant thickness.

6. The anchor of claim 1, wherein the angle between a bottom line of the fluke (2) and a line from the geometric center (G) of the fluke to the opening (20) is from 30 to 38°.

7. The anchor of claim 1, wherein the shank has an second opening (24) and wherein the angle between a bottom line of the fluke (2) and a line from the geometric center (G) of the fluke to the second opening (24) is from 40 to 50°.

8. The anchor of claim 1, wherein the fluke is provided with a sand-guide (12,14) at an upper side of the back (8).

9. The anchor of claim 1, wherein the shank is provided with a protruding portion (22) at its lower edge.

10. The anchor of claim 1, wherein the ratio of the surface of the fluke (2) to the weight of the anchor is higher than 100 $cm^2$/kg.

11. The anchor of claim 1, wherein the proportion of the weight of the anchor on the tip is higher than 20% when said anchor is in an anchoring position.

12. The anchor of claim 1, wherein the angle between a bottom line of the fluke (2) and a line form the geometric center (G) of the fluke to the opening (20) is about 34°.

13. The anchor of claim 1, wherein the shank has an second opening (24) and wherein the angle between a bottom line of the fluke (2) and a line from the geometric center (G) of the fluke to the second opening (24) is about 45°.

* * * * *